US009580977B2

(12) United States Patent
Vogt

(10) Patent No.: US 9,580,977 B2
(45) Date of Patent: Feb. 28, 2017

(54) BLOWOUT PREVENTER TRANSPORT AND HANDLING SYSTEM

(71) Applicant: Woolslayer Companies, Inc., Tulsa, OK (US)

(72) Inventor: Dewayne G. Vogt, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 591 days.

(21) Appl. No.: 14/023,943

(22) Filed: Sep. 11, 2013

(65) Prior Publication Data

US 2015/0068726 A1 Mar. 12, 2015

(51) Int. Cl.
*E21B 19/00* (2006.01)
*E21B 33/06* (2006.01)

(52) U.S. Cl.
CPC ..... *E21B 19/00* (2013.01); *E21B 33/06* (2013.01)

(58) Field of Classification Search
None
See application file for complete search history.

(56) References Cited

U.S. PATENT DOCUMENTS 4,359,089 A * 11/1982 Strate ..... E21B 33/06 166/383
4,821,816 A * 4/1989 Willis ..... E21B 15/00 175/57
5,388,930 A * 2/1995 McNease ..... B63B 27/02 405/196
8,353,132 B1 1/2013 Vogt et al.
2006/0180564 A1 8/2006 Keppel
2007/0193749 A1* 8/2007 Folk ..... E21B 7/02 166/379
2013/0199802 A1* 8/2013 Weir ..... E21B 33/06 166/387
2014/0332487 A1* 11/2014 Boutwell, Jr. ..... B66C 19/00 212/199

* cited by examiner

*Primary Examiner* — Jennifer H Gay
*Assistant Examiner* — Caroline Butcher
(74) *Attorney, Agent, or Firm* — Head, Johnson & Kachigian, P.C.

(57) ABSTRACT

A blowout preventer transport and handling system for a blowout preventer on a well rig. The system includes a skid for a receipt of a blowout preventer. A pair of trolley beams parallel to the skid are moveable between a lowered storage position and a raised use position. A trolley hoist mechanism is provided on each of the trolley beams. At least one cylinder moves the pair of trolley beams between the lowered storage position and the raised use position.

9 Claims, 7 Drawing Sheets

BLOWOUT PREVENTER TRANSPORT AND HANDLING SYSTEM

BACKGROUND OF THE INVENTION

1. Field of the Invention

The present invention relates to a transportation, storage and handling system for a blowout preventer for a subterranean well rig. In particular, the present invention is directed to an integrated system to store and transport a blowout preventer and to install, handle and support a blowout preventer during use on a well rig.

2. Related Art

Blowout preventers are known assemblies of valves used to control subterranean wells. Blowout preventers prevent uncontrolled flow or pressure during drilling, production or service operations. Blowout preventers will be utilized to confine well fluids to the well bore and, in addition, shut in the well and severe casing or drill pipe during emergencies.

Blowout preventers may be located and may be placed in various locations over the well center line. In some operations, the blowout preventer is located over the well center line above a sub base structure of the well rig and below a spaced drill or rig floor.

Periodically, it may be necessary to disassemble the entire rig and move all of the components, including the blowout preventer, to a new drilling, production or service location.

It would be desirable to provide an integrated system to retain a blowout preventer during transportation and storage.

It would also be desirable to provide a system to rotationally move a blowout preventer between a horizontal storage and transportation position and a vertical, in use position and then move the blowout preventer over a well center.

It would be further desirable to provide a transport and handling system to move a blowout preventer horizontally into position over a well center.

It would also be desirable to provide a blowout preventer transport and handling system that would be connected to the well rig and remain in place during operation of the well.

It would be further desirable to provide an integral system for rotating a blowout preventer between horizontal and vertical positions and for moving the blowout preventer horizontally with a hoist mechanism.

It would be further desirable to provide a blowout preventer transport and handling system that would require no external equipment for moving the blowout preventer into or out of position.

It would be further desirable to provide a blowout preventer transport and handling system that includes a pressure test mechanism to pressure test the blowout preventer prior to installation on a well rig.

SUMMARY OF THE INVENTION

The present invention is directed to a blowout preventer transport and handling system. The system includes a framework having a pair of trolley beams parallel to and spaced from a skid which supports the system. A pair of trolley beams are moveable between a lowered storage position and a raised, use position. Extending between the skid and trolley beams are a first set of swing-up links. The first set swing-up links rotates between a position parallel to the skid and a position vertical to the skid.

A handling cradle surrounds and secures the blowout preventer to the first pair of swing-up links.

An additional, second pair of swing-up links rotate between a position parallel to the skid and a position vertical to the skid.

At least one cylinder moves the trolley beams between the lowered storage position and the raised, use position.

A trolley hoist mechanism is provided on each of the trolley beams. The trolley hoist mechanisms move along the trolley beams by rollers or wheels.

The blowout preventer is secured at a lower end to a combination support collar and test mechanism so that the blowout preventer can be pressurized for test purposes. The support collar rotates about a pivot attached to the frame work so that the blowout preventer rotates between the lowered storage position and the upright position.

In order to install the blowout preventer on a rig, the system is brought up next to and adjacent the well rig with the skid resting on the ground. The cylinder begins extension and the swing-up links rotate so that the trolley beams move upward while remaining parallel to the skid. At the same time, the blowout preventer is rotated from the horizontal position until it reaches the vertical position.

Thereafter, the trolley hoist mechanisms are moved horizontally along the trolley beams until the trolley hoist mechanisms are adjacent the handling cradle. The hooks will be lowered and connected to the handling cradle and the support collar will be disconnected from the base of the blowout preventer. Thereafter, the trolley hoist mechanisms will be moved horizontally until the blowout preventer is over the well head.

Thereafter, the blowout preventer will be lowered over the well head and attached thereto. Finally, the hooks will be disconnected and the trolley hoist mechanisms will be moved horizontally out of the way.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
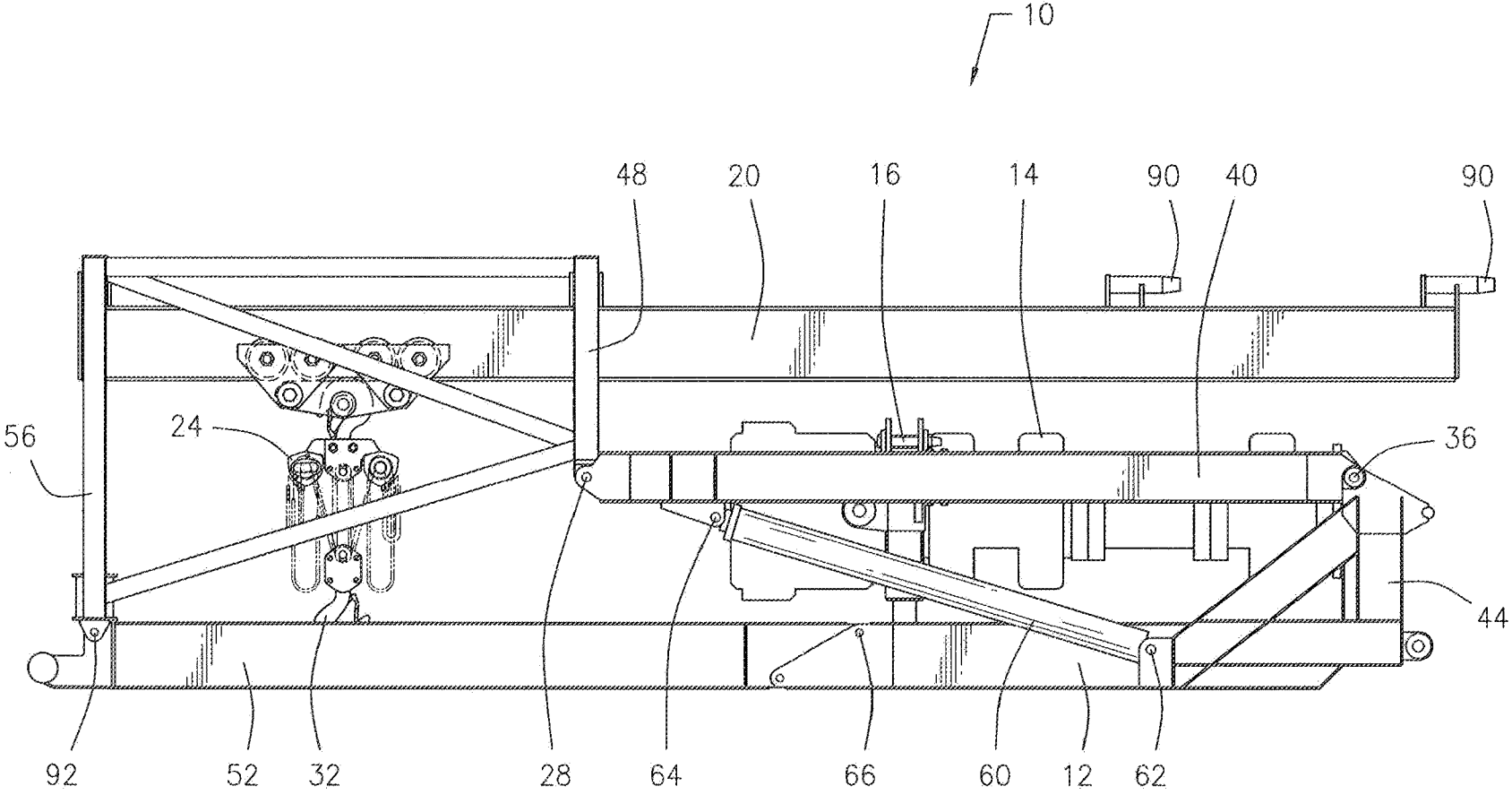
FIG. 1 illustrates a side view of a blowout preventer transport and handling system constructed in accordance with the present invention.

Referring to the drawings in detail, FIG. 1 illustrates a system 10 constructed in accordance with the present invention.

Figure 2:
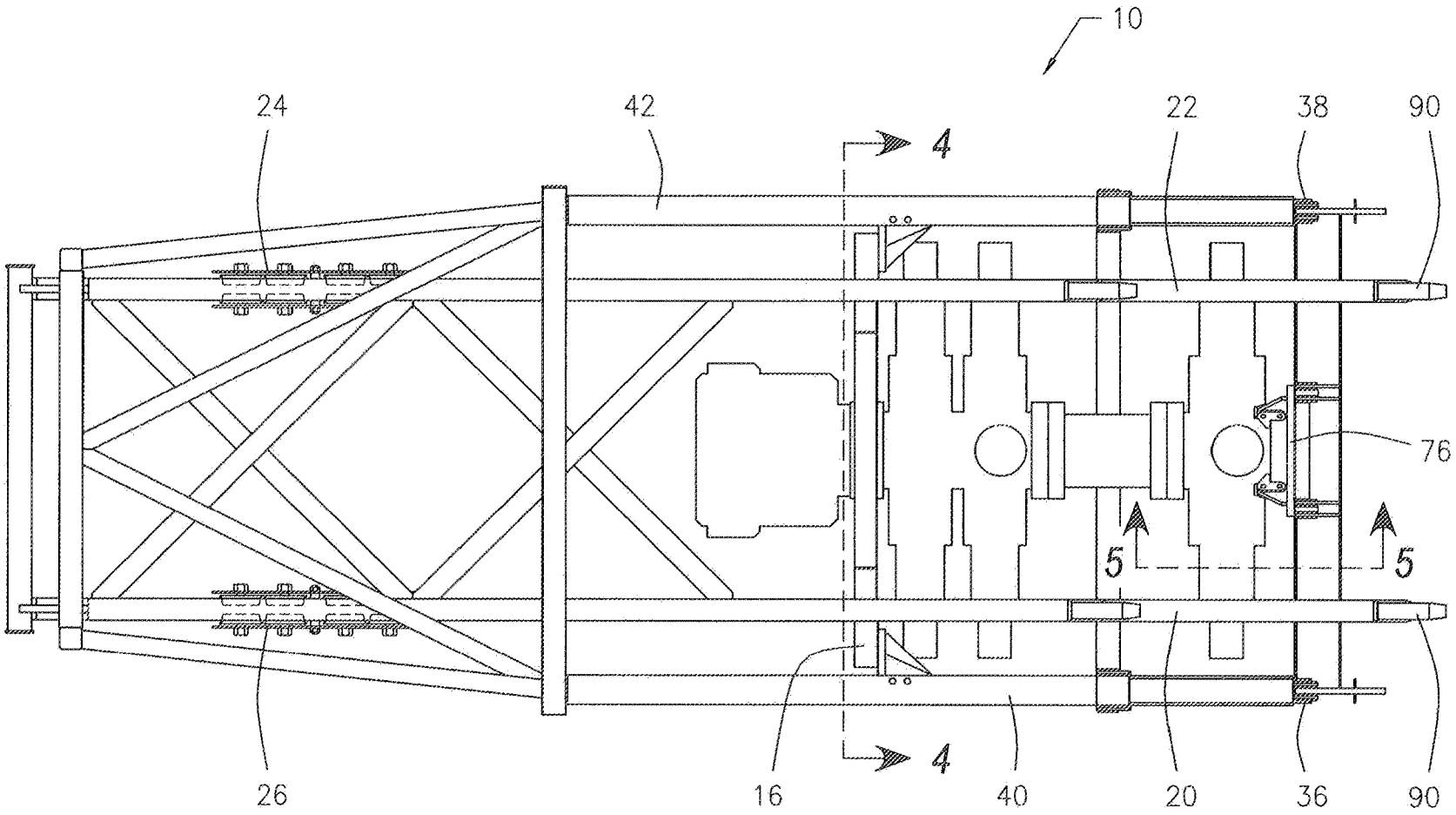
FIG. 2 illustrates a top view of the blowout preventer transport and handling system shown in FIG. 1.
Figure 3:
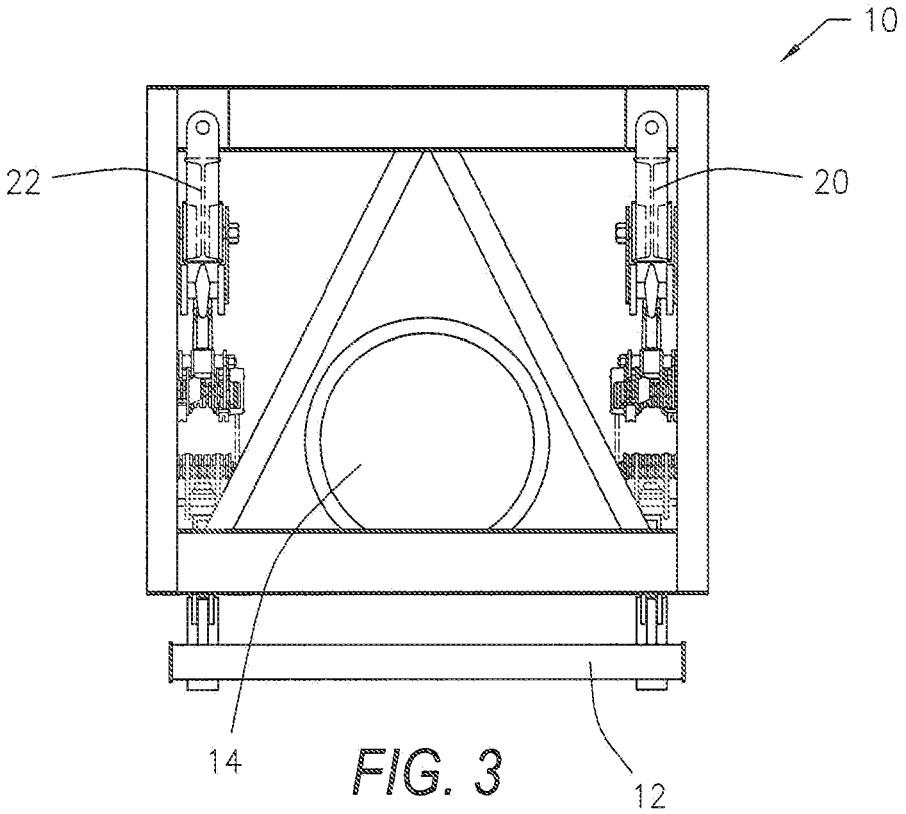
FIG. 3 illustrates an end view of the blowout preventer transport and handling system shown in FIG. 1.
Figure 4:
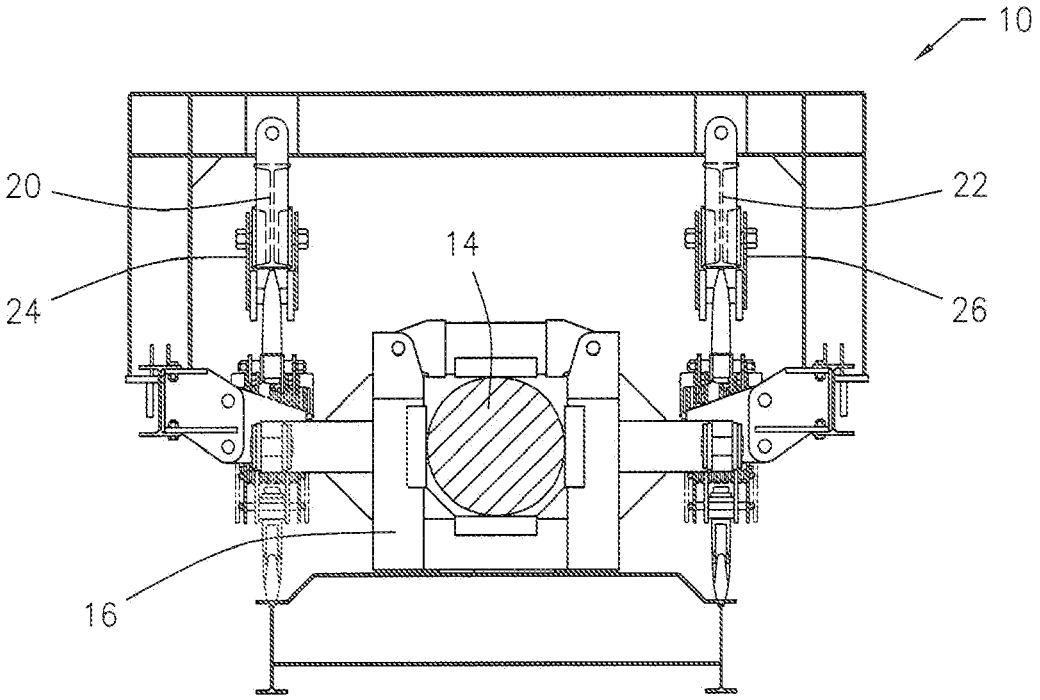
FIG. 4 illustrates a sectional view taken along section line 4-4 of FIG. 2.

FIGS. 1 through 4 illustrate a blowout preventer transport and handling system 10 in a lowered, storage and transportation position. In particular, FIG. 1 illustrates a side view, FIG. 2 illustrates a top view, FIG. 3 illustrates an end view and FIG. 4 illustrates a sectional view taken along section line 4-4 of FIG. 2. A skid 12 is provided for receipt of a blowout preventer 14. The skid 12 may take various forms and configurations, however, it may be designed to be receivable on a tractor trailer (not shown) for transportation of the entire system 10 from one location to the next. The entire system 10 in the lowered storage and transportation position will be no wider and no taller than permitted by highway regulations.

A blowout preventer handling cradle 16 surrounds and secures the blowout preventer 14 to the system 10. Movement of the handling cradle 16 will translate to movement of the blowout preventer 14. In the storage position shown in FIG. 1, the cradle 16 rests on the skid 12.

A pair of trolley beams 20 and 22 are parallel to and spaced from the skid 12 (only one beam 20 is visible in FIG. 1). As will be described in detail, the pair of trolley beams 20 and 22 are moveable between the lowered storage and transportation position shown in FIGS. 1 through 4 and the raised, use position to be shown and described.

As best seen in FIGS. 1, 3, and 4, a trolley hoist mechanism 24 and 26 is provided on each of the trolley beams 20 and 22, respectively. The trolley hoist mechanisms move along the trolley beams. Each trolley hoist mechanism 24 and 26 includes a crane block, a hook or hooks 32 and 34 and a chain drive trolley.

In one non-limiting preferred embodiment, the trolley beams 20 and 22 are I-beams and a series of rollers or wheels engage the lower rail of the I-beam.

In the lowered storage and transportation position, the trolley hoist mechanisms 24 and 26 are disconnected from the blowout preventer 14 but remain mounted on the system 10. Accordingly, it is not necessary to install and then disassemble the trolley hoist mechanisms.

Extending between the skid 12 and the trolley beams 20 and 22 are a first set of swing-up links 40 and 42. In the lowered storage position, the first set of swing-up links 40 and 42 is parallel to the skid 12.

Each of the swing-up links 40 and 42 is connected at one end to the skid 12 through uprights 44 and 46, respectively, at pivots 36 and 38. The opposed end of each swing-up link 40 and 42 is connected to one of the trolley beams 20 and 22 through a pivotal connection to framework 48 and 50, respectively, at pivots 28 and 30.

The handling cradle 16 is attached to the swing-up links 40 and 42. Accordingly, as the swing-up links 40 and 42 rotate between a position parallel to the skid and a position vertical to the skid 12, the blowout preventer will rotate.

An additional, second pair of swing-up links 52 and 54 are each connected at one end to the skid 12 at pivots 66 and 68, respectively. An opposed end of each swing-up link 52 and 54 is connected to the trolley beams 20 and 22 through a pivotal connection to framework 56 and 58 at pivots 92 and 94. Accordingly, the swing-up links 52 and 54 rotate between a position parallel to the skid and an upright position vertical to the skid. Accordingly, the trolley beams 20 and 22 move between a lowered storage position shown in FIGS. 1 through 4 and a raised use position to be described in detail.

At least one cylinder moves the pair of trolley beams 20 and 24 between the lowered storage position and the raised use position. In a preferred embodiment, a single hydraulic ram cylinder 60 is utilized. One end of the hydraulic ram cylinder 60 is pivotally connected at pivot 62 to the skid 12. The opposed end of the cylinder 60 is pivotally connected to the swing-up link 40 at pivot 64. When the cylinder is retracted, the system 10 is in the lowered storage position.

The trolley hoist mechanisms 24 and 26 includes rollers or wheels so that the trolley hoist mechanism 24 will move along the trolley beam 20 while the trolley hoist 26 will move along the trolley beam 24.

Figure 5:
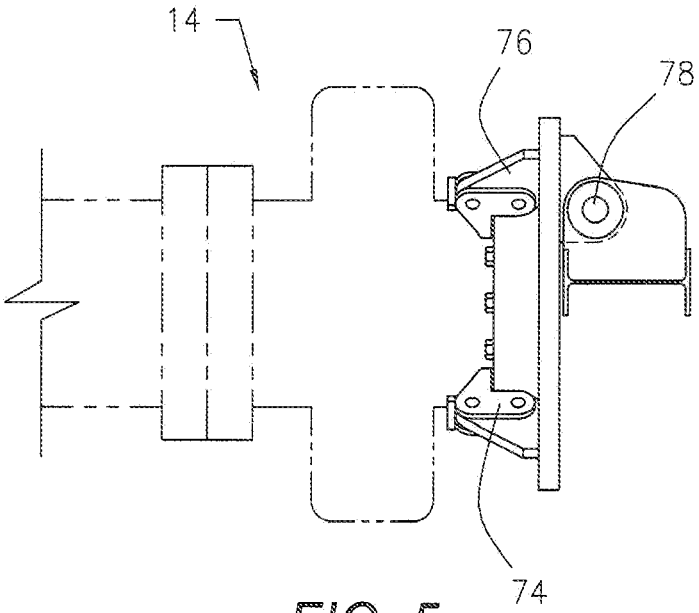
FIG. 5 illustrates a sectional view taken along section line 5-5 of FIG. 2.
Figure 6:
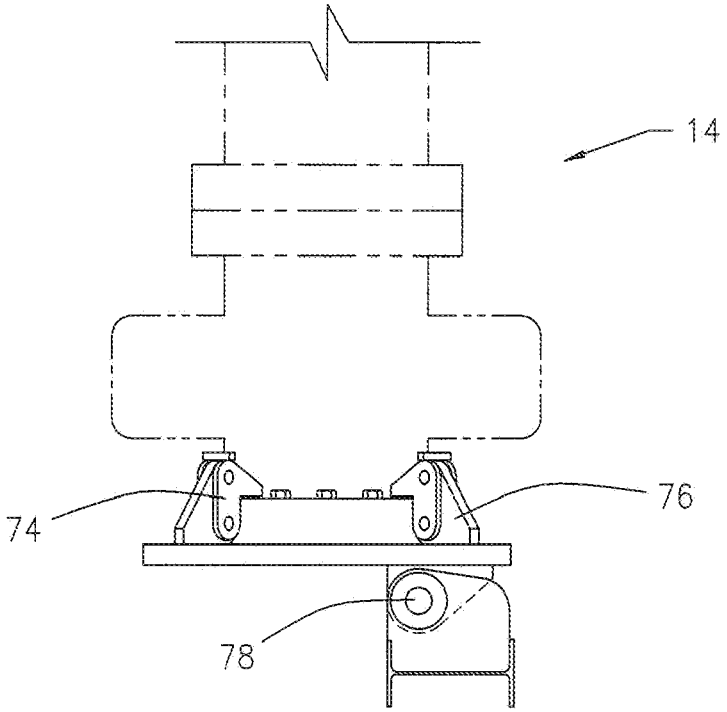
FIG. 6 illustrates the blowout preventer shown in FIG. 5 rotated from a horizontal to a vertical position.

FIG. 5 is a sectional view taken along sectional line 5-5 of FIG. 2 showing a portion of the blowout preventer 14 in dashed lines. The blowout preventer 12 is secured at a lower end to a combination support collar and test mechanism 76 by a plurality of clips or dogs 74, which are attached to the blowout preventer 14. FIG. 6 illustrates the blowout preventer 14 in dashed lines rotated to an upright position. Accordingly, the support collar 76 rotates about a pivot 78 between the lowered storage position shown in FIG. 5 and the upright position shown in FIG. 6. The support collar 76 also includes a pressure test mechanism having built in taps to connect to a hydraulic system, such as the existing hydraulic system on the well rig. The blowout preventer 14 can thus be pressurized for test purposes prior to installation.

FIGS. 7, 8, 9 and 10 illustrate sequential views of the installation of a blowout preventer 14 on a well rig 78. The well rig 78 includes a subfloor 80, and a substructure 82, which supports a raised drill floor 84.

Figure 7:
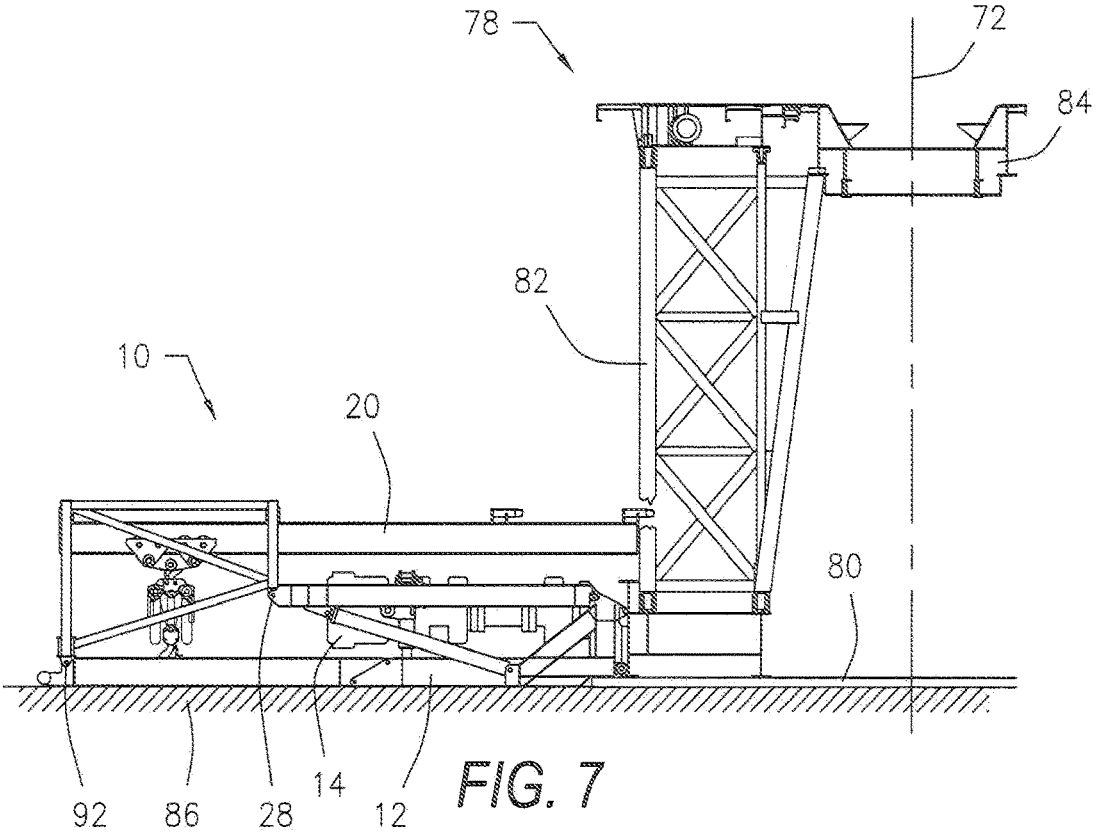
FIGS. 7 through 10 illustrate sequential views of the installation of the blowout preventer transport and handling system.

In FIG. 7, the blowout preventer transport and handling system 10 has been brought up next to and adjacent the subfloor 80 and substructure 82. The system may optionally be attached to the substructure and/or the subfloor. The skid 12 is resting on the ground 86. The system is in the lowered storage position and the blowout preventer 14 is shown in the horizontal position.

Figure 8:
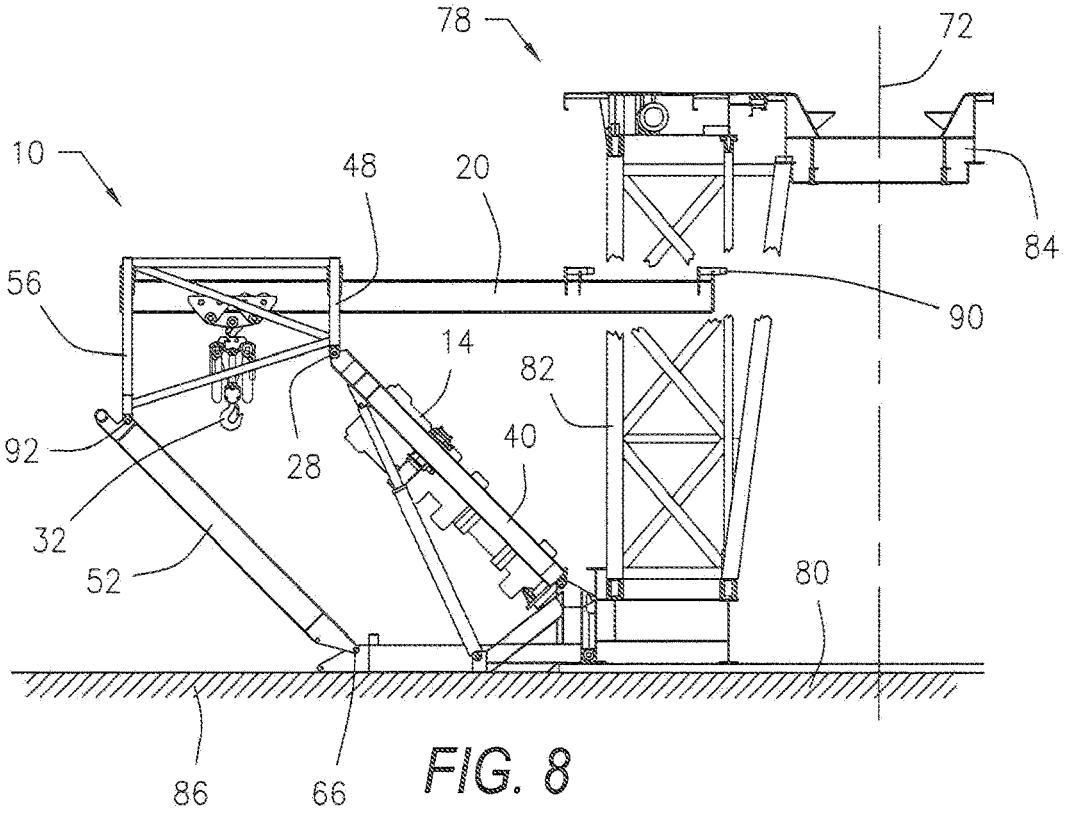

FIG. 8 shows the next sequential step in the procedure. The cylinder 60 begins to extend and the swing-up links 40 and 42 along with the swing-up links 52 and 54 rotate so that the trolley beams 20 and 22 move upward. At the same time, the blowout preventer 14 begins to rotate from the horizontal storage position.

Figure 9:
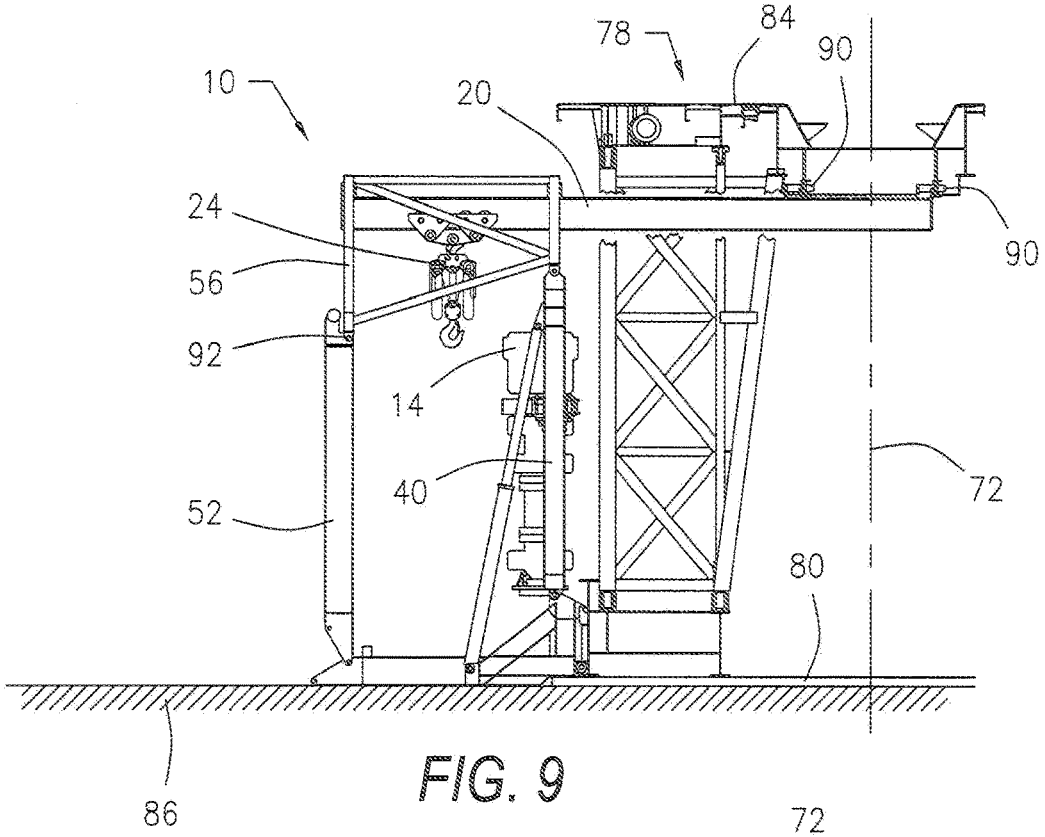

FIG. 9 illustrates the next sequential step in the procedure. As the cylinder continues to extend, the swing-up links 40 and 42 continue to rotate until they are perpendicular to the skid 14. At the same time the swing-up links 52 and 54 continue to rotate until they are perpendicular to the skid. As the trolley beams 20 and 22 continue to rise, a plurality of tapered pins 90 will engage eyes on the lower side of the drill floor 84. Once in the upright position, thus, the transport and handling system 10 is secured to the well rig 78.

Figure 10:
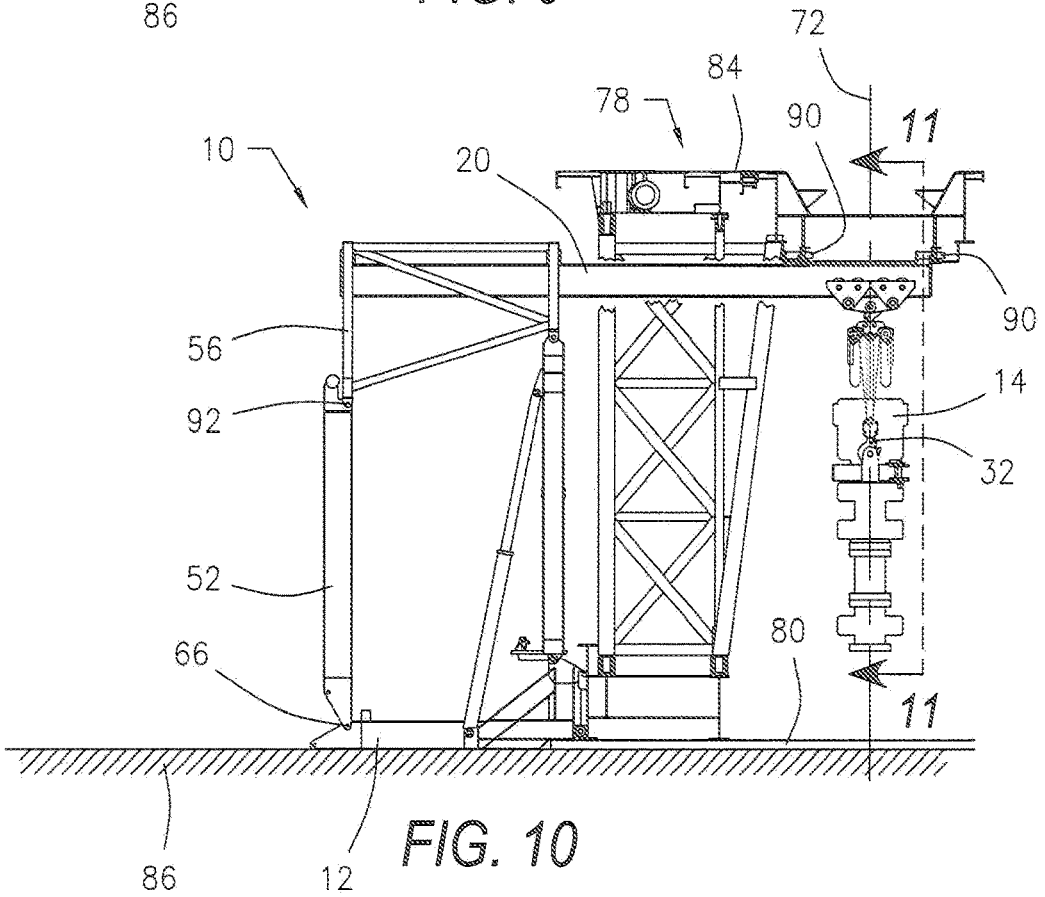

FIG. 10 shows the next sequential step in the procedure. The blowout preventer 14 is in an upright position but not over the well center line 72 in FIG. 9. The trolley hoist mechanisms 24 and 26 are moved horizontally along the trolley beams until the trolley hoist mechanisms are adjacent the blowout preventer. Thereafter, the hooks 32 and 34 will be lowered in order to engage the handling cradle of the blowout preventer. Thereafter, the support collar 76 will be disconnected from the blowout preventer so that the blowout preventer is supported by the trolley hoist mechanisms. Finally, the blowout preventer is moved horizontally until it is at the center line 72 over the well head.

Figure 11:
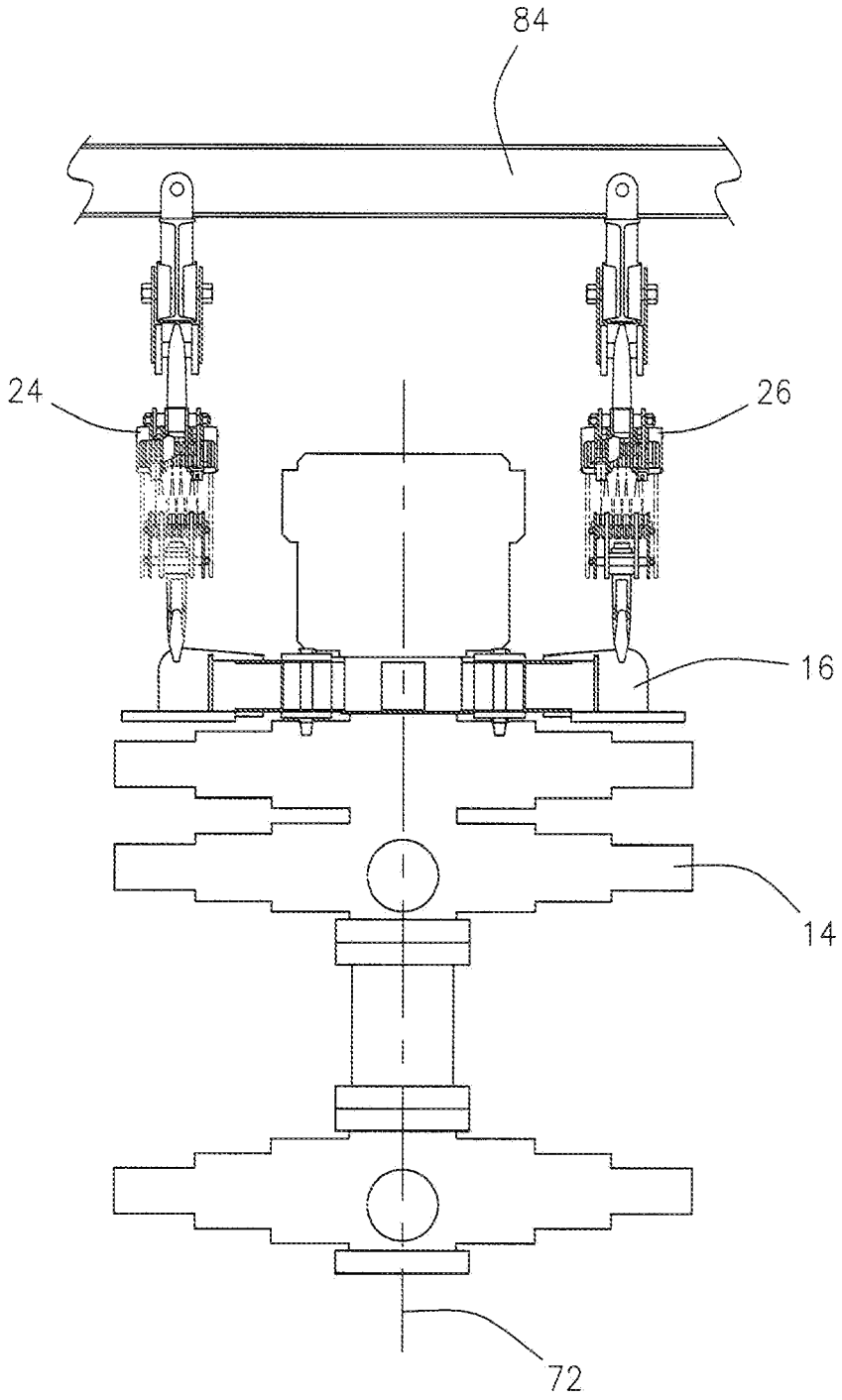
FIG. 11 is a sectional view taken along section line 11-11 of FIG. 10 and illustrates the blowout preventer supported by the trolley hoist mechanisms of the system of present invention.

FIG. 11 illustrates a sectional view taken along section line 11-11 of FIG. 10.

The blowout preventer 14 will then be lowered down over the well head and attached thereto. Thereafter, the hooks 32 and 34 will be disconnected from the support collar 76 and the trolley hoist mechanisms 24 and 26 will be moved horizontally back to a storage position away from the blowout preventer 14.

In order to remove the blowout preventer 14 from the well rig, the reverse procedure is employed.

Whereas, the present invention has been described in relation to the drawings attached hereto, it should be understood that other and further modifications, apart from those shown or suggested herein, may be made within the spirit and scope of this invention.

What is claimed is:

1. A blowout preventer transport and handling system for a blowout preventer on a well rig, which system comprises:

a skid for receipt of a blowout preventer;

a pair of trolley beams parallel to and spaced from said skid, said pair of trolley beams movable between a lowered storage position and a raised use position;

a plurality of swing-up links attached to said blowout preventer, each of said plurality of swing-up links extending between said skid and one of said trolley beams wherein said swing up links rotate between a lowered storage and a raised use position;

a trolley hoist mechanism on each of said trolley beams;

at least one cylinder to move said pair of trolley beams and said plurality of swing-up links between said lowered storage position and said raised use position; and a combination support collar and pressure test mechanism attached to said blowout preventer, said combination port collar and test mechanism rotatable about a pivot and movable with said blowout preventer between said lowered storage position and said raised use position.

2. The blowout preventer transport and handling system as set forth in claim 1 including at least one handling saddle to support said blowout preventer in a horizontal position.

3. The blowout preventer transport and handling system as set forth in claim 1 wherein each said trolley hoist mechanism includes crane blocks, a hook mechanism and a chain drive trolley and wherein said hook mechanism is engageable with said blowout preventer.

4. The blowout preventer transport and handling system as set forth in claim 1 wherein said at least one cylinder is a hydraulic ram cylinder.

5. The blowout preventer transport and handling system as set forth in claim 4 wherein said hydraulic ram cylinder extends between said skid and said plurality of swing-up links.

6. The blowout preventer transport and handling system as set forth in claim 1 wherein said system is attachable to said well rig.

7. The blowout preventer transport and handling system as set forth in claim 6 wherein said well rig includes a sub base and a drill floor spaced therefrom and wherein said trolley beams include tapered pins that engage eyes on said drill floor when in said raised use position.

8. The blowout preventer transport and handling system for a blowout preventer as set forth in claim 1 wherein said skid is receivable on a tractor trailer.

9. The blowout preventer transport and handling system for a blowout preventer as set forth in claim 1 wherein said combination support collar and pressure test mechanism is secured to said blowout preventer by a plurality of dogs.

* * * * *